US009131559B2

(12) United States Patent
Lai

(10) Patent No.: US 9,131,559 B2
(45) Date of Patent: Sep. 8, 2015

(54) HEAT DISSIPATING METHOD FOR LIGHT EMITTING DIODE AND LIGHTING DEVICE USING SAME

(71) Applicant: HON HAI PRECISION INDUSTRY CO., LTD., New Taipei (TW)

(72) Inventor: Chih-Chen Lai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 249 days.

(21) Appl. No.: 13/892,316

(22) Filed: May 13, 2013

(65) Prior Publication Data

US 2014/0167615 A1 Jun. 19, 2014

(30) Foreign Application Priority Data

Dec. 17, 2012 (TW) ..... 101147765

(51) Int. Cl.
*H05B 33/00* (2006.01)
*H05B 33/08* (2006.01)

(52) U.S. Cl.
CPC ..... *H05B 33/0803* (2013.01); *H05B 33/0884* (2013.01)

(58) Field of Classification Search
CPC ..... H05B 33/0803; H05B 33/0821; H05B 33/0875; H05B 33/0878; H05B 33/0884; H05B 33/0887; H05B 33/089
See application file for complete search history.

(56) References Cited

U.S. PATENT DOCUMENTS

| | | | | |
|---|---|---|---|---|
| 5,680,025 | A * | 10/1997 | Bowers et al. | 318/806 |
| 2008/0151499 | A1* | 6/2008 | Tsai | 361/697 |
| 2009/0303735 | A1* | 12/2009 | Chen | 362/373 |
| 2010/0315004 | A1* | 12/2010 | Horng et al. | 315/117 |
| 2011/0012512 | A1* | 1/2011 | Young et al. | 315/117 |
| 2011/0121983 | A1* | 5/2011 | Chen | 340/635 |
| 2012/0081007 | A1* | 4/2012 | Sun et al. | 315/117 |
| 2012/0098434 | A1* | 4/2012 | Sondericker, III | 315/113 |
| 2013/0187969 | A1* | 7/2013 | Miyahara | 347/14 |

* cited by examiner

*Primary Examiner* — Jung Kim
(74) *Attorney, Agent, or Firm* — Novak Druce Connolly Bove + Quigg LLP

(57) ABSTRACT

A heat dissipating method for a light emitting diode is provided. The heat dissipating method includes following steps. Firstly, a circuit board with a light emitting diode formed on one side and a heat dissipating fan formed on the other side is provided. The heat dissipating fan is configured to dissipate heat for the light emitting diode. Secondly, a power source is provided for supplying power for the light emitting diode. Finally, a speed of the heat dissipating fan is adjusted according to an input power of the power source. A lighting device using the heat dissipating method is also provided.

10 Claims, 3 Drawing Sheets

HEAT DISSIPATING METHOD FOR LIGHT EMITTING DIODE AND LIGHTING DEVICE USING SAME

BACKGROUND

1. Technical Field

The disclosure generally relates to a heat dissipating method for a light emitting diode and a lighting device using the heat dissipating method.

2. Description of Related Art

In recent years, due to excellent light quality and high luminous efficiency, light emitting diodes (LEDs) have increasingly been used as substitutes for incandescent bulbs, compact fluorescent lamps and fluorescent tubes as light sources of illumination devices.

In a heat dissipating device of the light emitting diode, a temperature sensor is used to detect a temperature of the light emitting diode. If the temperature of the light emitting diode exceeds to a certain value, the temperature sensor will improve a heat dissipating efficiency of the heat dissipating device to decrease the temperature of the light emitting diode. However, in the method described above, the temperature sensor need some time to execute the operation of decreasing the temperature of the light emitting diode. In that time, the temperature of the light emitting diode may keep increasing and affect the lighting of the light emitting diode.

What is needed, therefore, is a heat dissipating method for a light emitting diode and a lighting device using the method to overcome the above described disadvantages.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Embodiments of a lighting device and a heat dissipating method of a light emitting diode will now be described in detail below and with reference to the drawings.

Figure 1:
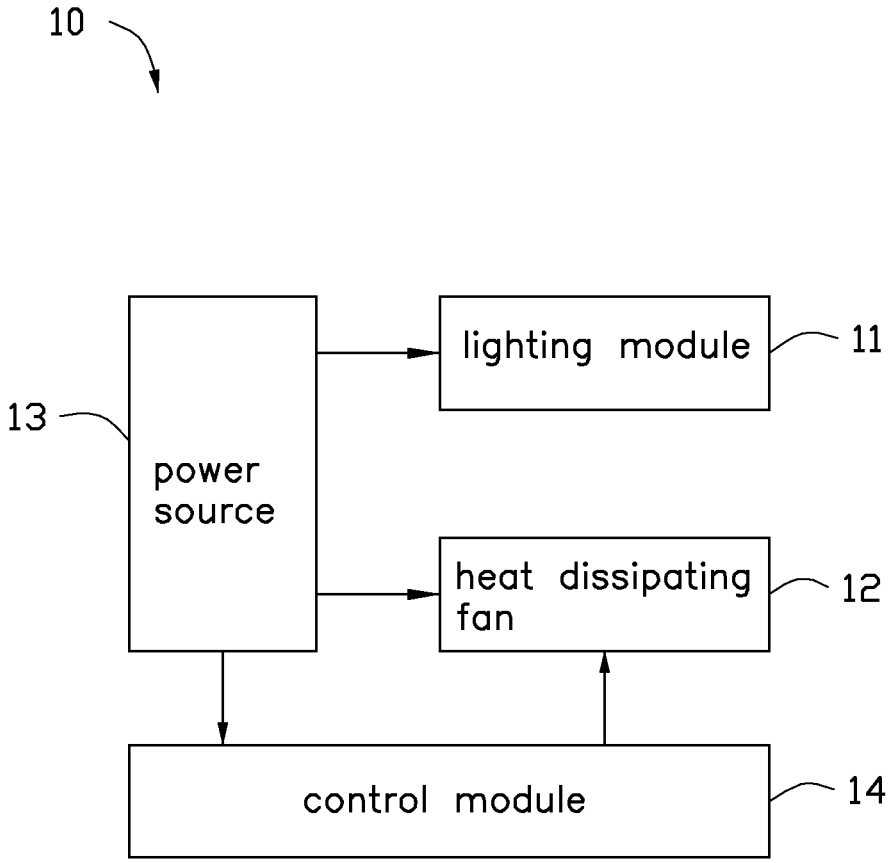
FIG. 1 is an illustrating view of a lighting device in accordance with an embodiment of the present disclosure.
Figure 2:
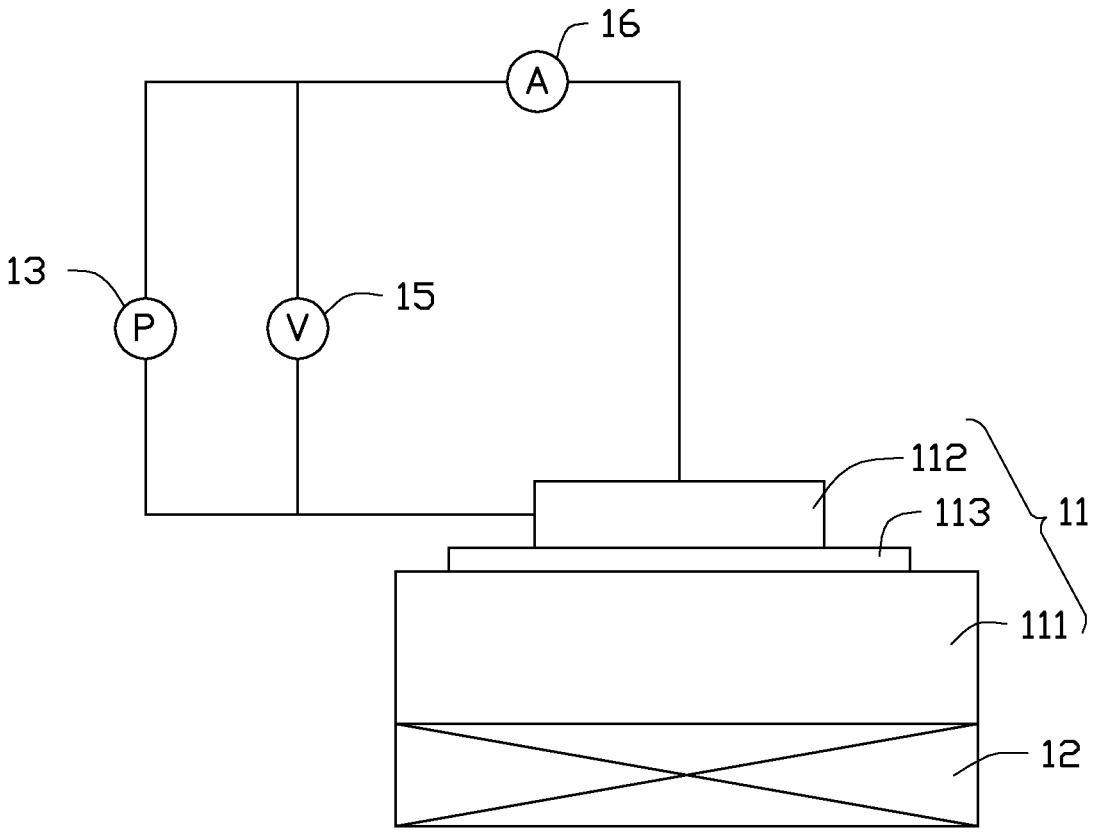
FIG. 2 is an illustrating view of a lighting module of the lighting device in FIG. 1.

Referring to FIGS. 1-2, a lighting device 10 in accordance with an embodiment is provided. The lighting device 10 includes a lighting module 11, a heat dissipating fan 12, a power source 13 and a control module 14.

The lighting device 10 includes a circuit board 111 and a light emitting diode 112 formed on the circuit board 111. The heat dissipating fan 12 is formed at one side of the circuit board 111 opposite to the light emitting diode 112 to dissipate heat generated by the light emitting diode 112. The power source 13 is configured to provide power for the light emitting diode 112.

The control module 14 is electrically connected with the heat dissipating fan 12 and the power source 13. The control module 14 adjusts a speed of the heat dissipating fan 12 according to an input power of the power source 13. That is, when the input power of the power source 13 increases, the control module 14 will increase the speed of the heat dissipating fan 12 to improve a heat dissipating efficiency of the heat dissipating fan 12, thereby making a temperature of the light emitting diode keep in a constant value. When the input power of the power source 13 decreases, the control module 14 will decrease the speed of the heat dissipating fan 12 to decrease the heat dissipating efficiency of the heat dissipating fan 12.

Preferably, the lighting device 10 further includes a voltmeter 15 and a galvanometer 16. The voltmeter 15 is parallel-connected between the power source 13 to determine an input voltage V of the power source 13. The galvanometer 16 is connected between the power source 13 and the light emitting diode 112 in series to determine an input current I of the power source 13. Therefore, the input power P of the power source 13 is calculated as following expression: P=V*I.

Preferably, in the process of adjusting the speed of the heat dissipating fan 12 according to the input power P of the power source 13, an additional amount of heat ΔQ generated by the light emitting diode 112 is firstly calculated according to the changing of the input power P of the power source 13. After that, a temperature variation ΔT is calculated according to the additional amount of heat ΔQ. Then, the speed of the heat dissipating fan 12 is adjusted according to the temperature variation ΔT determined above. In this embodiment, the temperature variation ΔT can be calculated as following. A thermal resistance $R_B$ of the circuit board 111, and a thermal resistance $R_L$ of the light emitting diode 112 are provided. The values of the thermal resistance $R_B$ and $R_L$ represent a temperature variation caused by the amount of heat of 1 watt (W). Therefore, the temperature variations ΔT of the light emitting diode 112 can be calculated according to following expression:

$$\Delta T = \Delta Q^* (R_B + R_L).$$

Preferably, a heat conductive glue 113 is formed between the light emitting diode 112 and the circuit board 111. At that time, in calculating the temperature variation ΔT of the light emitting diode 112, a thermal resistance $R_G$ of the heat conductive glue 113 is provided. The temperature variations ΔT of the light emitting diode 112 can be calculated according to following expression:

$$\Delta T = \Delta Q^* (R_B + R_L + R_G).$$

In the lighting device 10 described above, the control module 14 is provided to adjust the speed of the heat dissipating fan 12 according to the input power of the power source 13. When the input power of the power source 13 increases, the speed of the heat dissipating fan 12 is increased correspondingly to increase the heat dissipating efficiency of the heat dissipating fan 12. Therefore, a temperature of the light emitting diode 112 keeps unchanged. That is, the light device 10 does not need to adjust the speed of the heat dissipating fan 12 after the temperature of the light emitting diode 112 increases, and has a quick response to the temperature of the light emitting diode 112.

Figure 3:
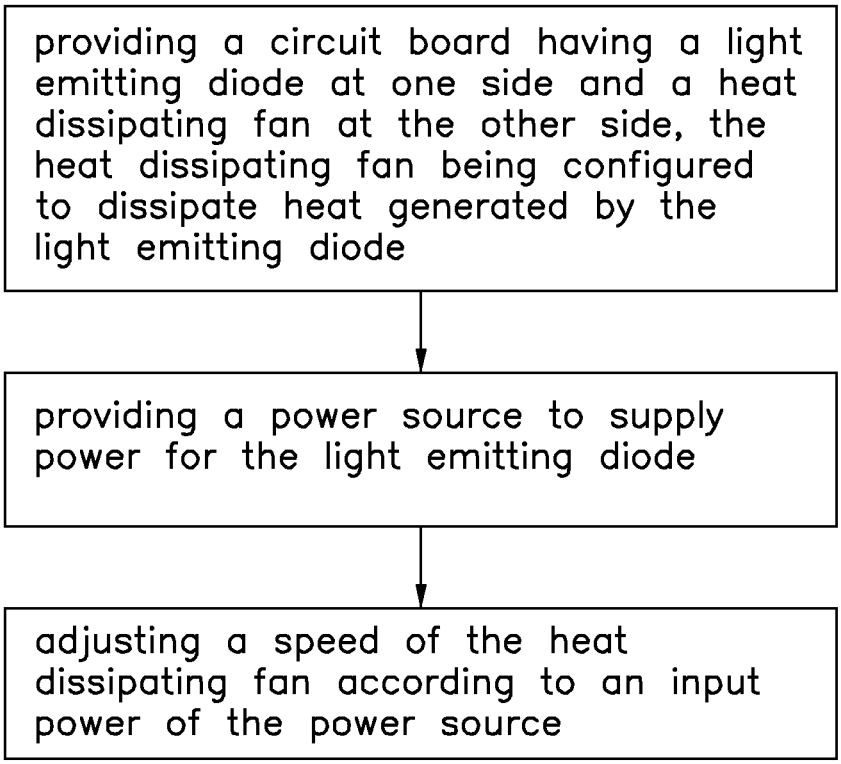
FIG. 3 is a flow chart of a heat dissipating method for a light emitting diode of the lighting device in FIG. 1.

A heat dissipating method for a light emitting diode is also provided. referring also to FIG. 3, the heat dissipating method includes following steps:

A circuit board 111 is provided. The circuit board 111 has a light emitting diode 112 formed on one side and a heat dissipating fan 12 formed on the other side. The heat dissipating fan 12 is configured to dissipate heat for the light emitting diode 112.

A power source 13 is provided. The power source 13 is configured to provide power for the light emitting diode 112.

A speed of the heat dissipating fan 12 is adjusted according to an input power P of the power source 13. That is, when the input power P of the power source 13 increases, the control module 14 will increase the speed of the heat dissipating fan 12 to improve a heat dissipating efficiency of the heat dissipating fan 12, thereby making a temperature of the light emitting diode keep in a constant value. When the input power P of the power source 13 decreases, the control module 14 will decrease the speed of the heat dissipating fan 12 to decrease the heat dissipating efficiency of the heat dissipating fan 12.

Preferably, a voltmeter 15 and a galvanometer 16 are further provided. The voltmeter 15 is parallel-connected between the power source 13 to determine an input voltage V of the power source 13. The galvanometer 16 is connected between the power source 13 and the light emitting diode 112 in series to determine an input current I of the power source 13. Therefore, the input power P of the power source 13 is calculated as following: P=V*I.

Preferably, in the process of adjusting the speed of the heat dissipating fan 12 according to the input power P of the power source 13, an additional amount of heat ΔQ generated by the light emitting diode 112 is firstly calculated according to the changing of the input power P of the power source 13. After that, a temperature variation ΔT is calculated according to the additional amount of heat ΔQ. Then, the speed of the heat dissipating fan 12 is adjusted according to the temperature variation ΔT determined above. In this embodiment, the temperature variation ΔT can be calculated as following. A thermal resistance $R_B$ of the circuit board 111, and a thermal resistance $R_L$ of the light emitting diode 112 are provided. The values of the thermal resistance $R_B$ and $R_L$ represent a temperature variation caused by the amount of heat of 1 watt (W). Therefore, the temperature variations ΔT of the light emitting diode 112 can be calculated according to following expression:

$$\Delta T = \Delta Q^* (R_B + R_L).$$

Preferably, a heat conductive glue 113 is further provided. The heat conductive glue 113 is formed between the light emitting diode 112 and the circuit board 111. At that time, in calculating the temperature variation ΔT of the light emitting diode 112, a thermal resistance $R_G$ of the heat conductive glue 113 is provided. The temperature variations AT of the light emitting diode 112 can be calculated according to following expression:

$$\Delta T = \Delta Q^* (R_B + R_L + R_G).$$

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A heat dissipating method for a light emitting diode, comprising following steps:

providing a circuit board with a light emitting diode formed on one side of the circuit board and a heat dissipating fan formed on the other side of the circuit board, the heat dissipating fan being configured to dissipate heat for the light emitting diode;

providing a power source for supplying power for the light emitting diode;

adjusting a speed of the heat dissipating fan according to an input power P of the power source; and providing a voltmeter and a galvanometer, the voltmeter being parallel-connected with the power source to determine an input voltage V of the power source, the galvanometer being connected between the power source and the light emitting diode in series to determine an input current I of the power source, the input power P of the power source is calculated as following expression: P=V*I.

2. The heat dissipating method of claim 1, wherein in the process of adjusting the speed of the heat dissipating fan according to the input power P of the power source, an additional amount of heat ΔQ generated by the light emitting diode is firstly calculated according to a changing of the input power P of the power source, after that, a temperature variation ΔT is calculated according to the additional amount of heat ΔQ, then, the speed of the heat dissipating fan is adjusted according to the temperature variation ΔT determined above.

3. The heat dissipating method of claim 2, wherein a thermal resistance $R_B$ of the circuit board and a thermal resistance $R_L$ of the light emitting diode are provided, a temperature variation ΔT of the light emitting diode can be calculated according to following expression:

$$\Delta T = \Delta Q^* (R_B + R_L).$$

4. The heat dissipating method of claim 3, further comprising a step of providing a heat conductive glue, the heat conductive glue being formed between the light emitting diode and the circuit board.

5. The heat dissipating method of claim 4, wherein a thermal resistance $R_G$ is provided, a temperature variation ΔT of the light emitting diode can be calculated according to following expression:

$$\Delta T = \Delta Q^* (R_B + R_L + R_G).$$

6. A lighting device, comprising:

a lighting module, comprising a circuit board and a light emitting diode formed on the circuit board;

a heat dissipating fan, formed on one side of the circuit board opposite to the light emitting diode to dissipate heat generated by the light emitting diode;

a power source supplying power for the light emitting diode;

a control module, electrically connected with the heat dissipating fan and the power source, the control module adjusting a speed of the heat dissipating fan according to an input power P of the power source; and a voltmeter and a galvanometer, the voltmeter being parallel-connected with the power source to determine an input voltage V of the power source, the galvanometer being connected between the power source and the light emitting diode in series to determine an input current I of the power source, the input power P of the power source is calculated as following expression: P=V*I.

7. The lighting device of claim 6, wherein when adjusting the speed of the heat dissipating fan according to the input power P of the power source, an additional amount of heat ΔQ generated by the light emitting diode is firstly calculated according to a changing of the input power P of the power source, after that, a temperature variation ΔT is calculated according to the additional amount of heat ΔQ, then, the speed of the heat dissipating fan is adjusted according to the temperature variation ΔT determined above.

8. The lighting device of claim 7, wherein a thermal resistance $R_B$ of the circuit board and a thermal resistance $R_L$ of the light emitting diode are provided, a temperature variation ΔT of the light emitting diode can be calculated according to following expression:

$$\Delta T=\Delta Q^*(R_B+R_L).$$

9. The lighting device of claim 8, further comprising a heat conductive glue, the heat conductive glue being formed between the light emitting diode and the circuit board.

10. The lighting device of claim 9, wherein a thermal resistance $R_G$ is provided, a temperature variation ΔT of the light emitting diode can be calculated according to following expression:

$$\Delta T=\Delta Q^*(R_B+R_L+R_G).$$

* * * * *